US007260874B2

(12) United States Patent
Hoover

(10) Patent No.: US 7,260,874 B2
(45) Date of Patent: Aug. 28, 2007

(54) SYSTEM, APPARATUS, AND METHOD OF REDUCING PRODUCTION LOSS FOR TEXTURED YARN AND OTHER RELATED METHODS

(75) Inventor: D. Lynn Hoover, Newton, NC (US)

(73) Assignee: American Linc Corporation, Gastonia, NC (US)

( * ) Notice: Subject to any disclaimer, the term of this patent is extended or adjusted under 35 U.S.C. 154(b) by 0 days.

(21) Appl. No.: 11/603,512

(22) Filed: Nov. 22, 2006

(65) Prior Publication Data

US 2007/0084180 A1 Apr. 19, 2007

Related U.S. Application Data

(62) Division of application No. 10/717,181, filed on Nov. 19, 2003, now Pat. No. 7,152,287.

(51) Int. Cl.
*D02G 1/12* (2006.01)

(52) U.S. Cl. ..... 28/221; 28/266

(58) Field of Classification Search ..... 28/258, 28/247, 220, 221, 281, 261, 289, 219, 253, 28/263–268, 262, 270, 278; 57/6, 208, 228, 57/227, 351, 284, 332, 333, 334; 226/170
See application file for complete search history.

(56) References Cited

U.S. PATENT DOCUMENTS 3,099,064 A * 7/1963 Haynes ..... 264/168
3,341,911 A * 9/1967 Smith ..... 28/266
3,351,993 A * 11/1967 Rosenstein et al. ..... 28/266
3,406,436 A * 10/1968 Clarke, Jr. ..... 28/250
3,503,100 A * 3/1970 Glynn et al. ..... 19/46
3,505,155 A * 4/1970 Balch et al. ..... 428/86
4,051,660 A 10/1977 Griset, Jr.
4,219,997 A 9/1980 Hatcher
4,368,612 A 1/1983 Eschenbach
4,610,131 A 9/1986 Escgenbach et al.
4,620,345 A 11/1986 Fleissner
5,233,736 A * 8/1993 Hill ..... 28/265
5,307,614 A 5/1994 Nabeshima et al.
5,483,730 A 1/1996 Hoover
5,613,285 A 3/1997 Chester et al.
5,775,079 A * 7/1998 Hoover ..... 57/59
5,804,115 A 9/1998 Burton et al.
6,119,320 A 9/2000 Weiss
6,302,308 B1 10/2001 Hoover et al.
6,360,519 B1 3/2002 Hoover
6,378,180 B2 4/2002 Maranca et al.
6,415,971 B1 7/2002 Hoover et al.
6,481,072 B1 11/2002 Hoover et al.

* cited by examiner

*Primary Examiner*—Amy B. Vanatta
(74) *Attorney, Agent, or Firm*—Schwartz Law Firm P.C.

(57) ABSTRACT

A yarn texturizing system, apparatus, and methods of reducing production loss or increasing production speed in a continuous textured yarn production process are provided. The system includes a yarn supply, a yarn stuffing container to produce textured yarn periodically released therefrom, a yarn draw to draw yarn from the yarn supply to the yarn stuffing container, a yarn conveyor belt positioned downstream from the yarn stuffing container, and a yarn bundler positioned between the yarn stuffing container and the yarn conveyor belt to bundle the textured yarn prior to deposit onto the yarn conveyor belt.

19 Claims, 12 Drawing Sheets

SYSTEM, APPARATUS, AND METHOD OF REDUCING PRODUCTION LOSS FOR TEXTURED YARN AND OTHER RELATED METHODS

RELATED APPLICATIONS

This application is a divisional of U.S. application Ser. No. 10/717,181, filed Nov. 19, 2003, now U.S. Pat. No. 7,152,287, which is incorporated herein by reference in its entirety.

BACKGROUND OF THE INVENTION

1. Field of the Invention

The present invention relates to the textile industry and, more particularly, to systems, devices, and methods of producing textured yarn.

2. Description of Related Art

In the textile industry, various systems have been developed over the years to textured yarn in a high speed, continuous production process such as for use in carpet related products or other textile products. As shown in the prior art FIG. 13, these systems often include a yarn supply, a false twister positioned downstream from the yarn supply to impact a false twist to the yarn to enhance cohesiveness, one or more draw rolls positioned downstream from the false twister, a stuffer box or can to crimp or otherwise form a texture in the yarn, a yarn conveyor belt positioned downstream from the stuffer box and positioned to receive the textured yarn thereon to convey the textured yarn downstream, a bulker positioned to receive the yarn conveyor and to initially heat bulk the textured yarn, a yarn conveyor retainer band positioned to overlie the bulked textured yarn to enhance retaining the bulked textured yarn on the yarn conveyor belt, a heat setting oven positioned to receive the yarn conveyor belt having the retained and bulked textured yarn, a yarn cooler, e.g. a fan(s), positioned downstream from the heat setting oven to cool the textured yarn, and a yarn take-up positioned downstream from the yarn cooler and the heat setting oven to take-up the yarn from the yarn conveyor belt.

In these prior art systems, much emphasis has been placed over the years on various crimping or texturizing containers and methods prior to depositing the textured yarn onto the conveyor belt. For example, some devices focus on spreading out the textured or crimped yarn onto the conveyor prior to entering the heat setting oven. Other devices have focused on receiving crimped yarn or tow from the stuffer box and deposit it in a uniform manner or standing up on the conveyor belt.

The present applicant, however, has recognized that despite these changes or developments in the production of textured yarn, the speed of producing textured yarn can be significantly slower than other types of yarn production, such as straight set. It is thought that this difference in some circumstances can be as much as 20% slower for textured production than for straight set production. As a result, more labor, more production shifts, longer production times, and/or more machine wear and tear can be required to achieve desired textured yarn production results. Applicant therefore has recognized a need to reduce production loss and increase production speed for textured yarn, especially in continuous textured yarn production processes.

SUMMARY OF THE INVENTION

In view of the foregoing, embodiments of the present invention advantageously provide a system, apparatus, and methods to substantially reduce production loss for textured yarn. Embodiments of the present invention also advantageously provide a system, apparatus, and methods of increasing production speed of textured yarn in a continuous production process. Embodiments of the present invention additionally advantageously provide a system, apparatus, and methods that significantly increase the amount of textured yarn mass that can be positioned in the same physical space such as on a conveyor belt of a selected width in a continuous production process.

Embodiments of the present invention further advantageously provide a system, apparatus, and methods of reducing production loss in textured yarn that are readily compatible with existing continuous textured yarn production processes without the necessity of replacing an entire continuous production process system. Embodiments of the present invention also further advantageously provide a system, apparatus, and methods to bundle textured yarn after being textured or crimped and prior to depositing the textured yarn onto a conveyor belt.

Still further, embodiments of the present invention advantageously provide a system, apparatus, and method of doing business which allow a textured yarn manufacturer or other textured yarn textile product producer to significantly reduce the amount of labor, production shifts, production times, and/or machine wear and tear. Embodiments of the present invention yet further provide a system, apparatus, and methods to enhance control of a continuous textured yarn production process by analyzing the production process as a whole and substantially synchronizing one or more drives for various devices within a production system. Embodiments of the present invention yet further still provide a system, apparatus, and methods of reducing production loss in textured yarn that includes compression of the textured yarn within a selected physical space, e.g., when positioned on a conveyor belt of a preselected width, prior to heat setting the textured yarn.

More particularly, an embodiment of the present invention advantageously provides a yarn texturizing system including a yarn supply having yarn positioned thereon, a yarn stuffing container positioned downstream from the yarn supply to receive the yarn from the yarn supply so that the received yarn is stuffed within the yarn stuffing container and periodically released therefrom in a crimped position to thereby define textured yarn, and a yarn draw positioned downstream from the yarn supply to draw the yarn to the yarn stuffing container at a selected speed. The system also includes a yarn conveyor belt positioned downstream from the yarn stuffing container to receive textured yarn thereon and a yarn bundler positioned between the yarn stuffing container and the yarn conveyor belt to bundle the textured yarn prior to being received on the yarn conveyor belt so that the textured yarn passing through the yarn bundler defines bundled textured yarn. The system further includes a heat setting oven positioned downstream from the yarn bundler so that the yarn belt having the bundled textured yarn thereon passes through the heat setting oven to heat set the bundled textured yarn when passing therethrough and a yarn take-up positioned downstream from the heat setting oven to take-up the bundled textured yarn after being heat set.

An embodiment of the present invention also provides an apparatus to bundle textured yarn. The apparatus, for example, can be a yarn bundler having a yarn bundling tube and a yarn bundling tube drive positioned to rotate the yarn bundling tube about an imaginary tube axis extending through substantially an entire lengthwise extent of the yarn bundling tube so that when textured yarn enters the yarn bundling tube the rotating of the tube imparts a bundling of the textured yarn prior to the textured yarn exiting the yarn bundling tube. The bundling, for example, can be a light or loose twist, or other turning, wrapping, intertwining, imparted along a lengthwise extent of a bundle of textured yarn to enhance grouping, collecting, agitation, or positioning of the textured yarn. The bundling, for example, also can reduce or eliminate outward travel of yarn on a conveyor belt toward outer peripheries of the belt prior to entry into a heat setting oven.

By bundling the textured yarn in a controlled manner, the amount of textured yarn mass positioned onto a moving conveyor belt of a preselected width can be significantly increased. Because the amount of textured yarn mass can be significantly increased, a continuous textured yarn production process is significantly enhanced by allowing the process to run at significantly higher speeds. As a result, similar quantities of textured yarn can be produced faster thereby reducing labor costs, the number of production shifts needed, and production times and allowing increased flexibility for textured yarn production operations. A compressor advantageously can also be used to compress the bundled textured yarn to further enhance handling, compactness, and positioning of the bundled textured yarn as it moves down a conveyor belt.

Embodiments of the present invention also provide methods of producing textured yarn. A method of producing textured yarn includes crimping yarn to define textured yarn, bundling the textured yarn to define bundled textured yarn, depositing the bundled textured yarn onto a conveyor, and taking up the textured yarn after heating the bundled textured yarn.

Another embodiment of a method of producing textured yarn includes rotating a yarn bundler about an imaginary axis extending through the yarn bundler, receiving the textured yarn into the rotating yarn bundler, and bundling the textured yarn prior to exiting the yarn bundler.

Still another method of producing textured yarn includes providing a yarn texturizer; increasing a speed of yarn travel being supplied to the yarn texturizer, and increasing the amount of textured yarn mass deposited onto a preselected area of a moving conveyor belt having a preselected width and positioned adjacent the yarn texturizer when increasing the speed of yarn travel so that the amount of textured yarn mass is greater than the amount of textured yarn mass deposited in the preselected area at a slower speed.

The present invention additionally provides a method for increasing production speed in a textured yarn production process. The method includes bundling textured yarn, depositing the bundled texturized yarn onto a moving conveyor, and compressing the bundled textured yarn when moving on the conveyor.

The present invention also provides a method of doing business including charging a fee for the amount of money saved by a textured yarn manufacturer for reducing production loss in a continuous textured yarn production process. The fee, for example, can be a percentage of the money saved by the textured yarn manufacturer.

By providing a system, apparatus, and methods of reducing production loss in textured yarn, yarn manufacturers can significantly reduce production speeds of textured yarn production systems and processes. In turn, this saves time, money, and labor and substantially increases flexibility for a manufacturer such as associated with scheduling needs, meeting customer demands, and the ability to attempt to produce various types of customized textured yarn or textile products. Such a system, apparatus, and methods of embodiments of the present invention also advantageously allow a textured yarn manufacturer to increase production speed and/or decrease production loss and yet only pay for such enhancements if money is saved by the manufacturer.

BRIEF DESCRIPTION OF THE DRAWINGS

Some of the features and advantages of the present invention having been stated, others will become apparent as the description proceeds when taken in conjunction with the accompanying drawings, in which.

DETAILED DESCRIPTION

The present invention now will be described more fully hereinafter with reference to the accompanying drawings in which illustrated embodiments of the invention are shown. This invention, however, may be embodied in many different forms and should not be construed as limited to the illustrated embodiment set forth herein; rather, these embodiment are provided so that this disclosure will be thorough and complete, and will fully convey the scope of the invention to those skilled in the art. Like numbers refer to like elements throughout.

Figure 1:
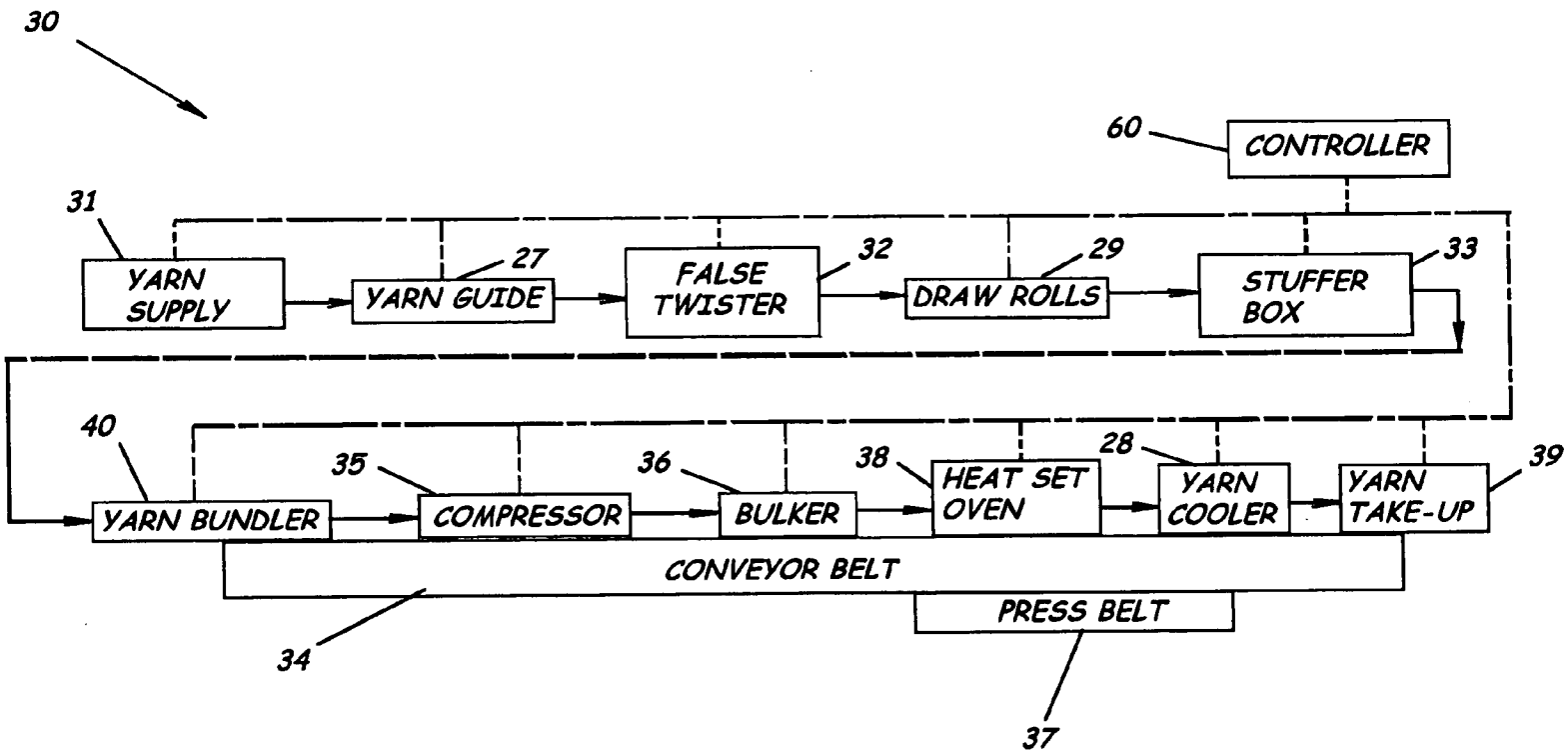
FIG. 1 is a schematic block diagram of a system to reduce production loss in textured yarn according to an embodiment of the present invention.
Figure 2:
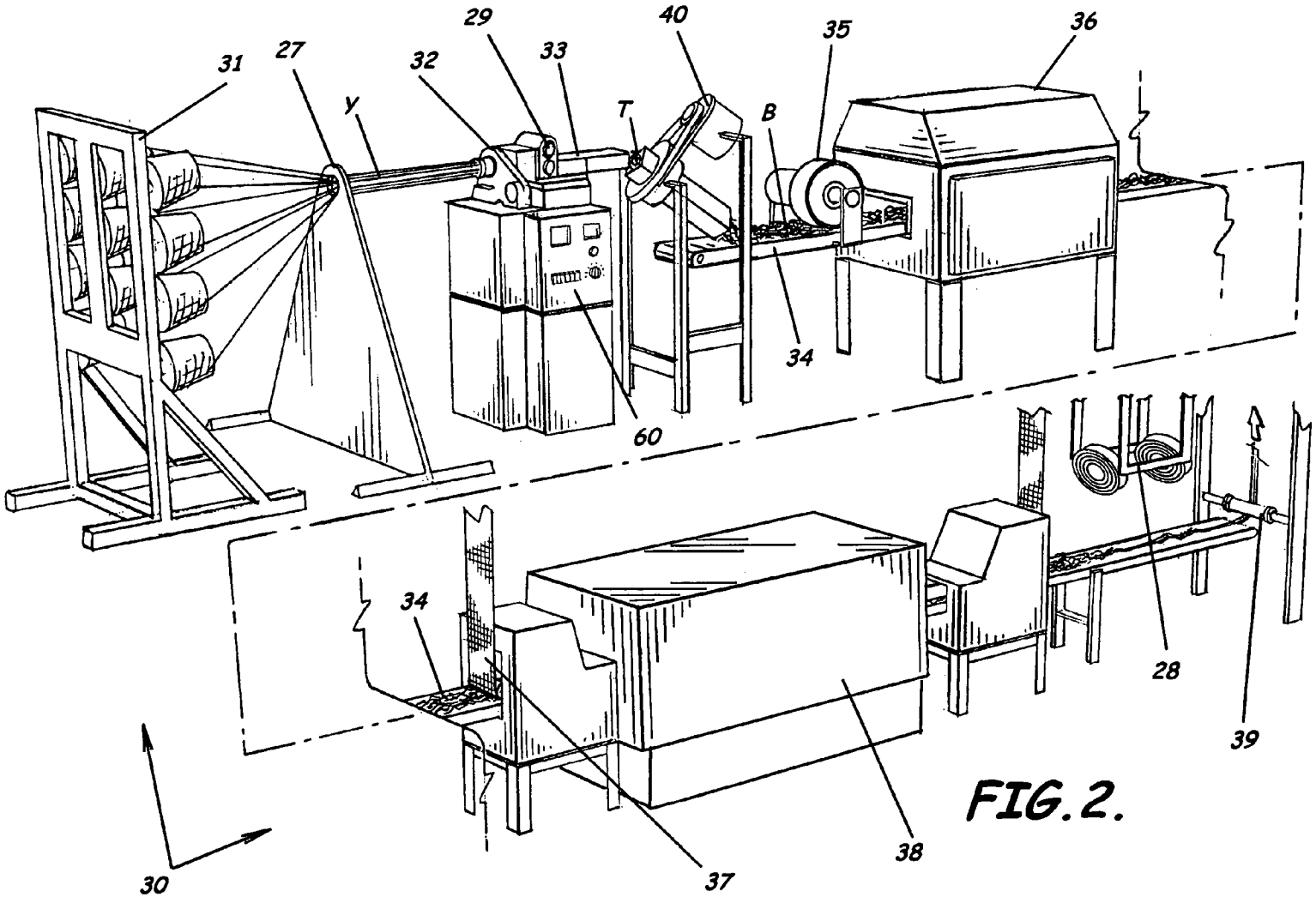
FIG. 2 is a perspective view of a system to reduce production loss in textured yarn according to an embodiment of the present invention.
Figure 3:
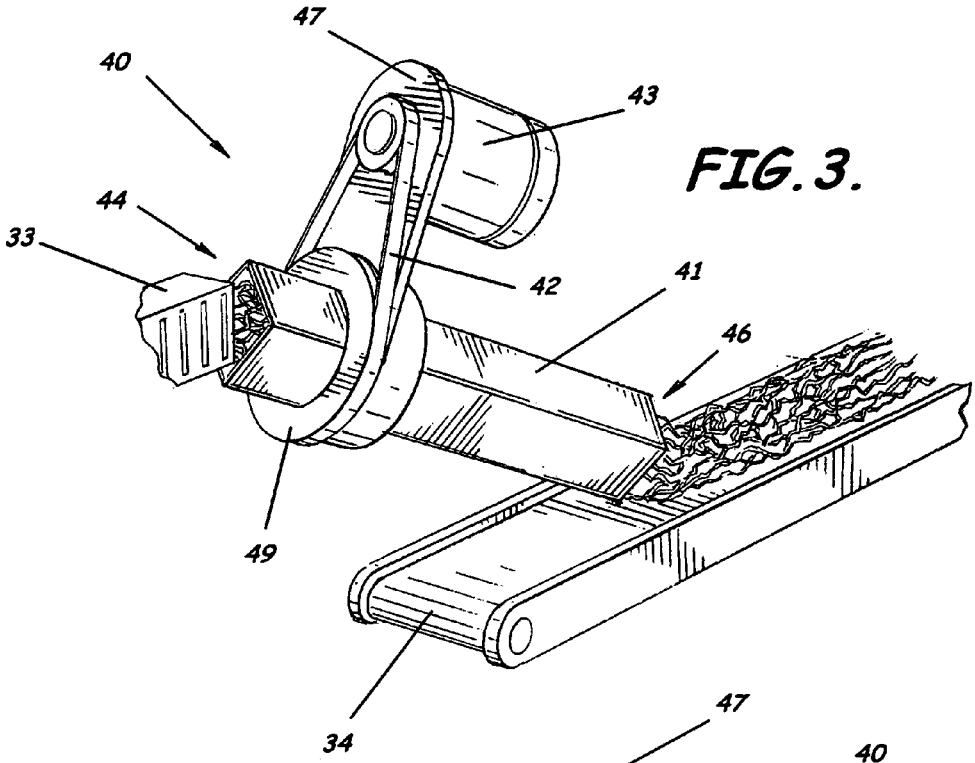
FIG. 3 is a perspective view of an embodiment of a yarn bundler of a system to reduce production loss in textured yarn according to an embodiment of the present invention.
Figure 4:
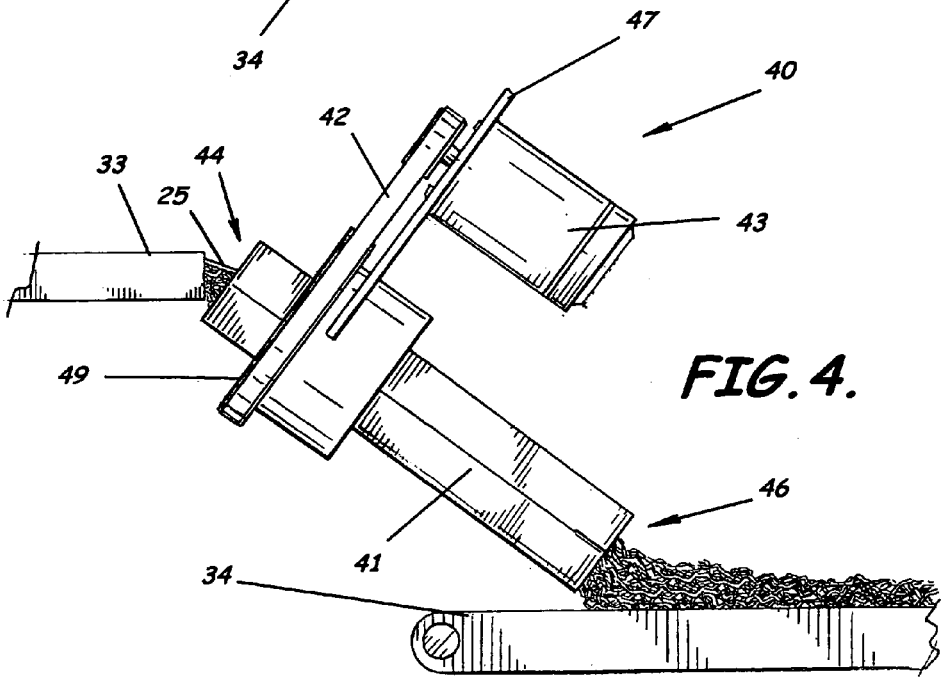
FIG. 4 is a side elevational view of an embodiment of a yarn bundler of a system to reduce production loss in textured yarn according to an embodiment of the present invention.
Figure 6:
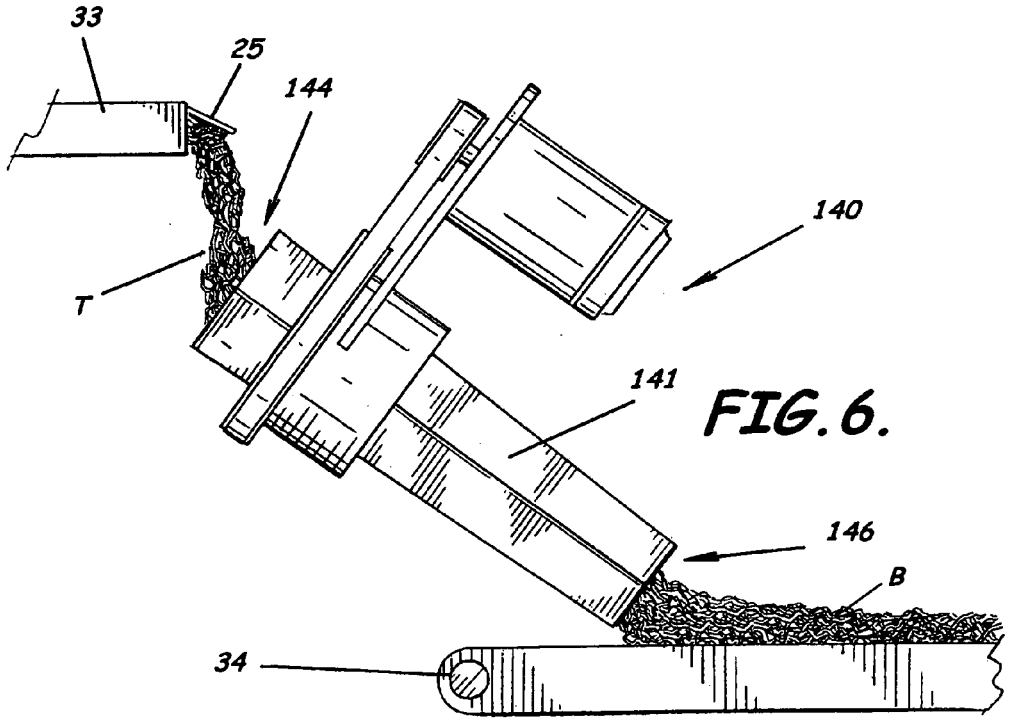
FIG. 6 is a side elevational view of another embodiment of a yarn bundler of a system to reduce production loss in textured yarn according to an embodiment of the present invention.
Figure 7:
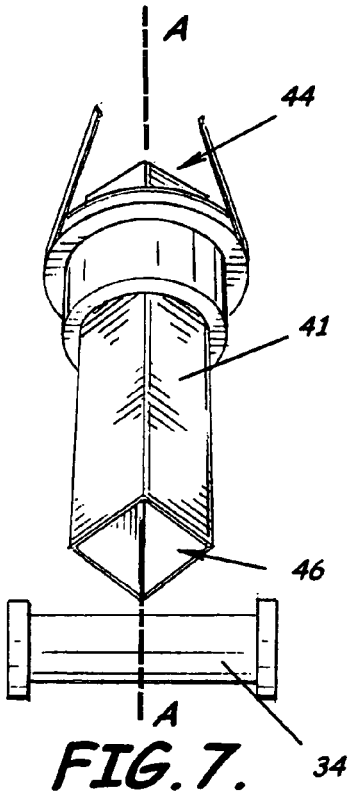
FIG. 7 is a perspective view of yet another embodiment of a yarn bundler of system to reduce production loss in textured yarn according to an embodiment of the present invention.
Figure 8:
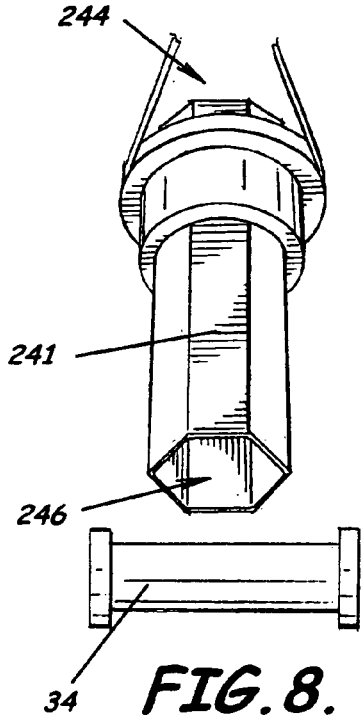
FIG. 8 is a perspective view of still another embodiment of a yarn bundler of a system to reduce production loss in textured yarn according to an embodiment of the present invention.
Figure 9:
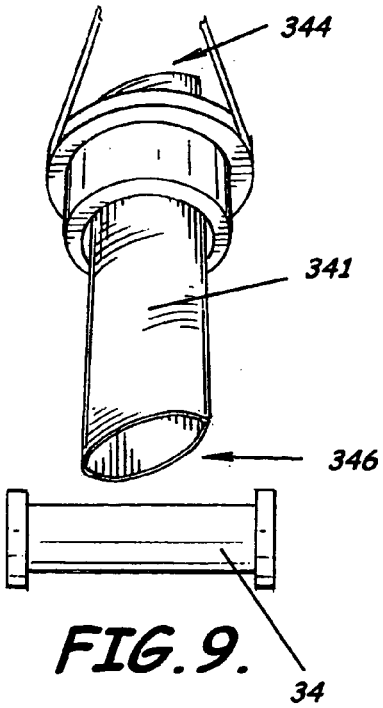
FIG. 9 is a perspective view of a further embodiment of a yarn bundler of a system of reducing production loss in textured yarn according to an embodiment of the present invention.
Figure 10:
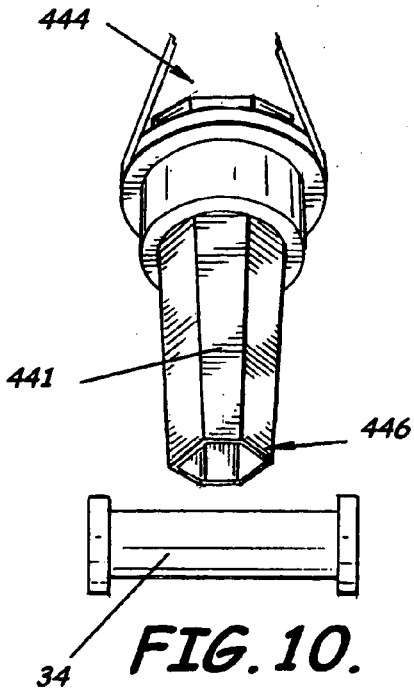
FIG. 10 is a perspective view of still a further embodiment of a yarn bundler of a system of reducing production loss in textured yarn according to an embodiment of the present invention.
Figure 11:
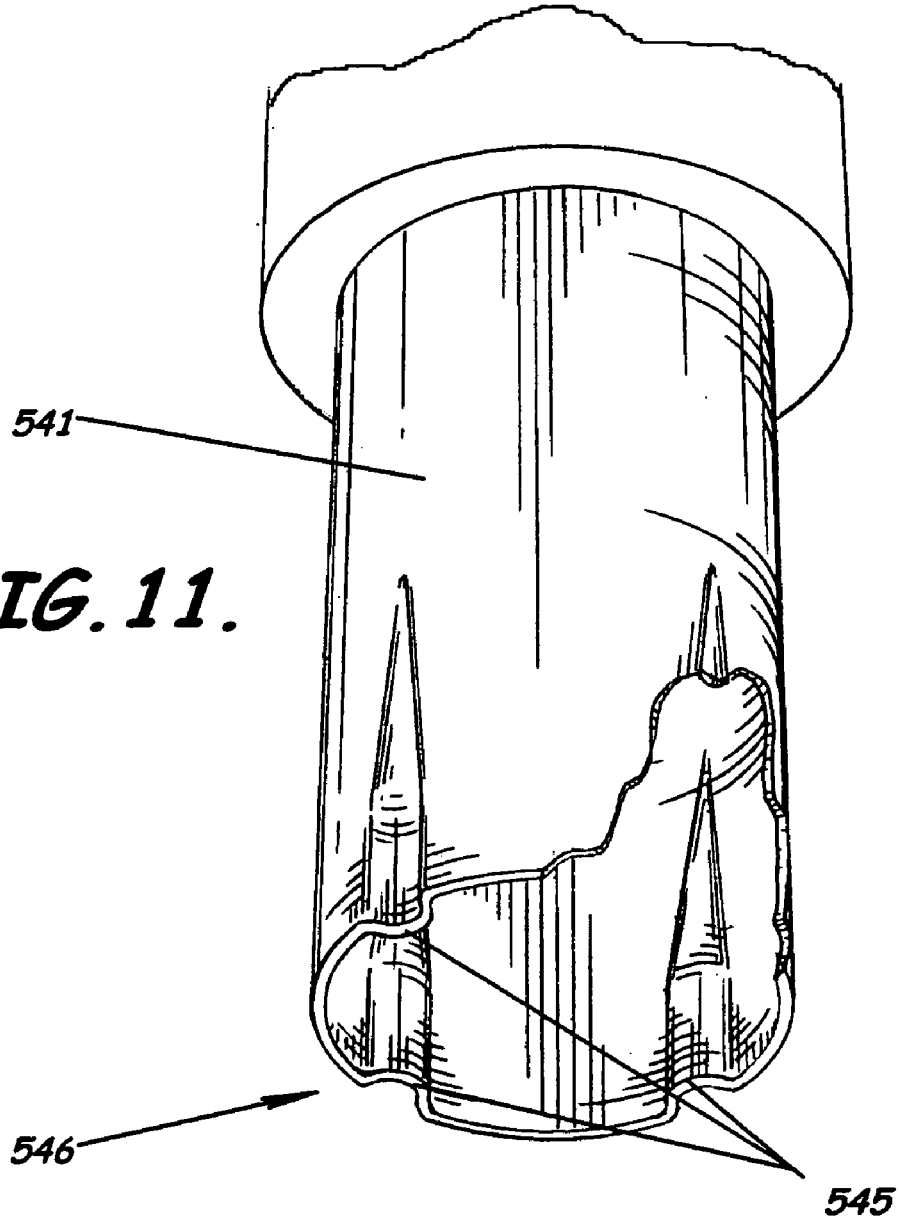
FIG. 11 is a fragmentary perspective view of yet a further embodiment of a yarn bundler having portions thereof broken away for clarity of a system to reduce production loss in textured yarn according to an embodiment of the present invention.
Figure 12:
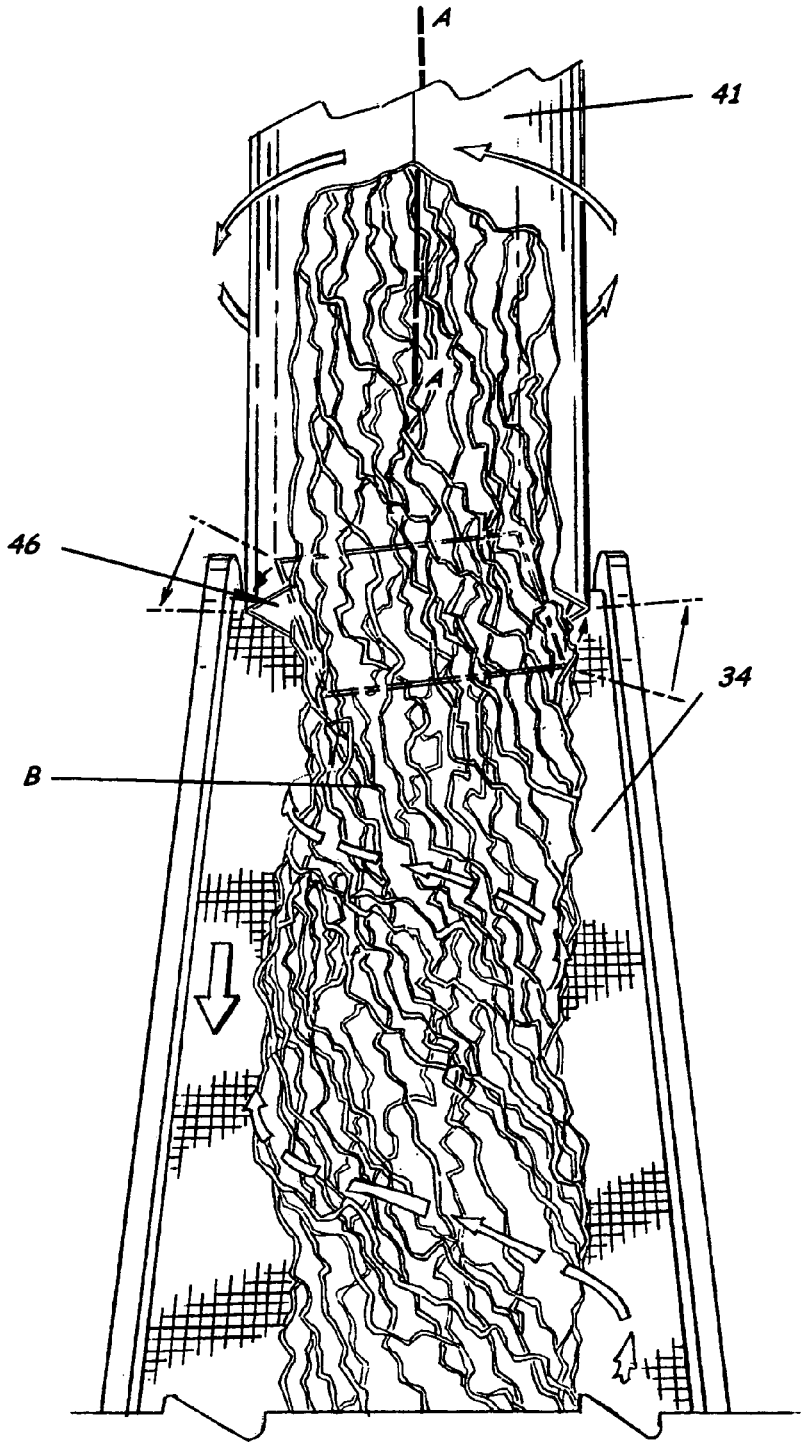
FIG. 12 is a fragmentary perspective view of an embodiment of a yarn bundler having portions thereof broken away for clarity and a yarn conveyor having bundled textured yarn positioned thereon of a system to reduce production loss in textured yarn according to an embodiment of the present invention.
Figure 16:
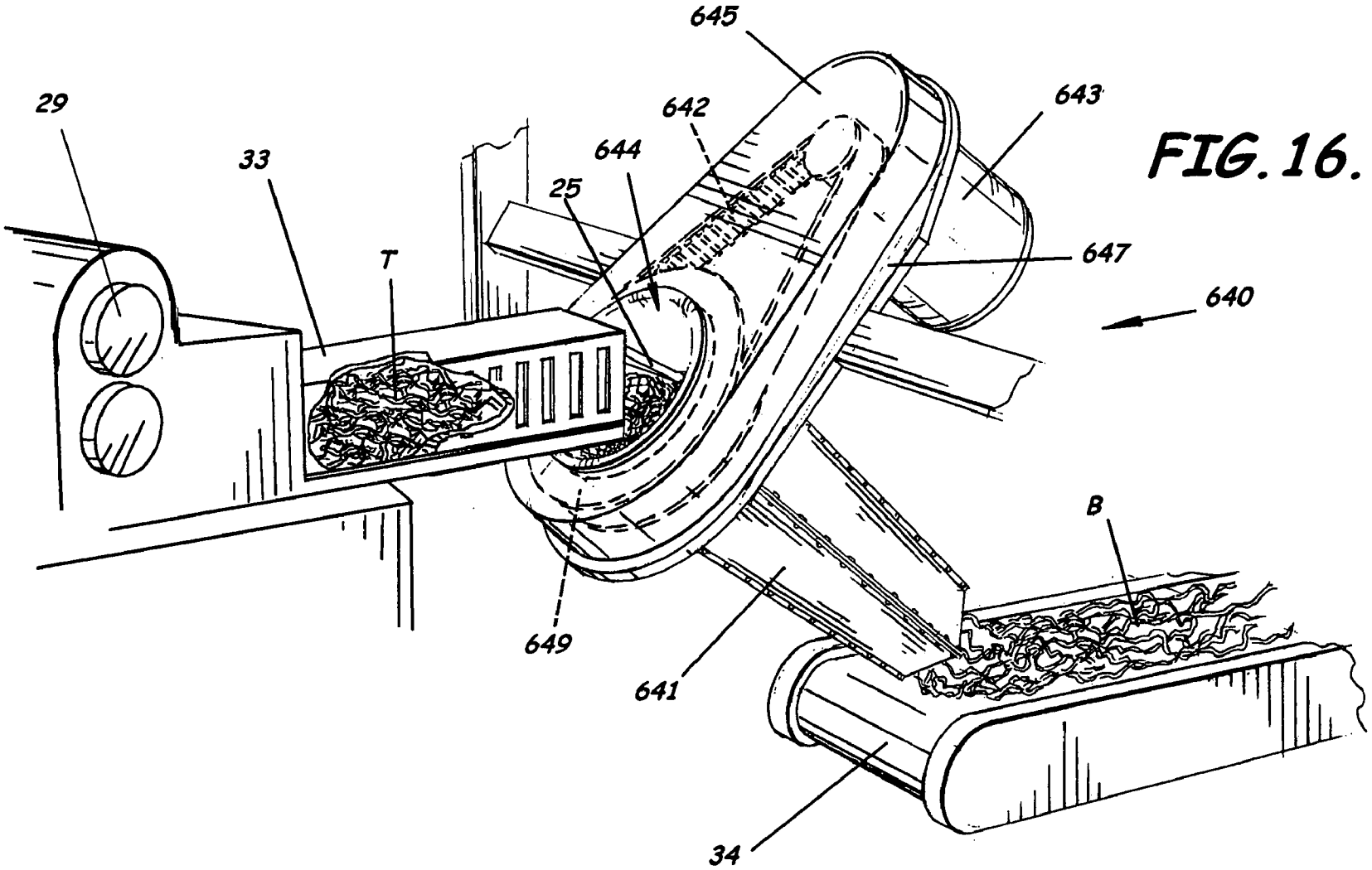
FIG. 16 is a fragmentary perspective view of a system to reduce production loss in textured yarn according to still a further embodiment of the present invention.
Figures 17, 18, 19, 20, 21:
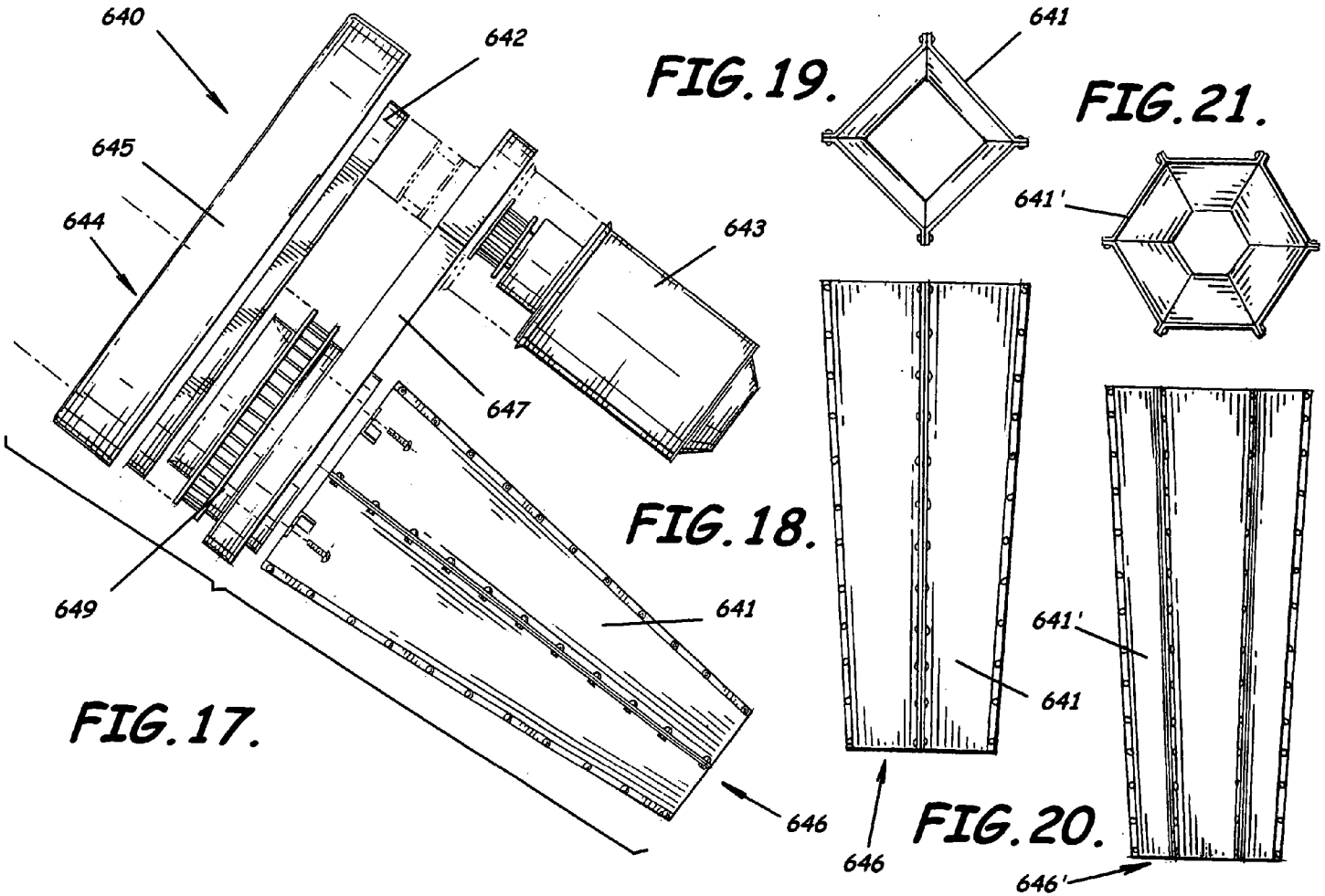
FIG. 17 is a side elevational view of another embodiment of a yarn bundler and drive of a system to reduce production loss in textured yarn according to another embodiment of the present invention.
FIG. 18 is a top plan view of another embodiment of a yarn bundler of a system to reduce production loss in textured yarn according to another embodiment of the present invention.
FIG. 19 is a front plan view of the embodiment of a yarn bundler of FIG. 18 of a system to reduce production loss in textured yarn according to another embodiment of the present invention.
FIG. 20 is a top plan view of still another embodiment of a yarn bundler of a system to reduce production loss in textured yarn according to still another embodiment of the present invention.
FIG. 21 is a front plan view of the embodiment of a yarn bundler of FIG. 20 of a system to reduce production loss in textured yarn according to an embodiment of the present invention.

FIGS. 1-2 and 16 illustrate an embodiment of a yarn texturizing system 30 to reduce the production loss in textured yarn T and, particularly, in a high speed, continuous textured yarn production process. The system 30 includes a yarn supply 31 or yarn feed having yarn Y, e.g., untextured yarn or tow, positioned thereon, a yarn guide 27 guidingly receiving a plurality of yarn strands therethrough, a false twister 32 positioned downstream from the yarn supply 31 to impart a false twist to the yarn Y so that cohesiveness among strands or sliver is enhanced, and a yarn stuffing container 33, e.g., a stuffer box or can as understood by those skilled in the art, (see FIG. 16) positioned downstream from the yarn supply 31 to receive the yarn Y from the yarn supply 31, i.e., through the false twister 32, so that the received yarn Y is stuffed within the yarn stuffing container 33 and periodically released therefrom in a crimped position to thereby define textured yarn T. As understood by those skilled in the art, the periodical release from textured yarn T from the stuffing container 33 can be by accumulated pressure on a pivoting door 25 (see FIG. 6), by timingly opening of a closure such as a door or valve by a controller 60 or other device, or by other techniques as understood by those skilled in the art. The system 30 also includes a yarn draw 29, e.g., one or more draw rolls, positioned downstream from the yarn supply 31 to draw the yarn Y to the yarn-stuffing container 33, i.e., through the false twister 32, at a selected speed. The yarn draw 29 and other drive related components of the system 30 are preferably controlled by a controller 60, e.g., an industrial contoller having stored program control, a computer, or other controller as understood by those skilled in the art, which interfaces with or otherwise communicates with one or more motors to control the drive of the draw rolls 29 and other components of the system, e.g., the false twister 32, a yarn bundler 40, a conveyor belt 34, a compressor 35, and a yarn take-up 39, as understood by those skilled in the art.

Figure 13:
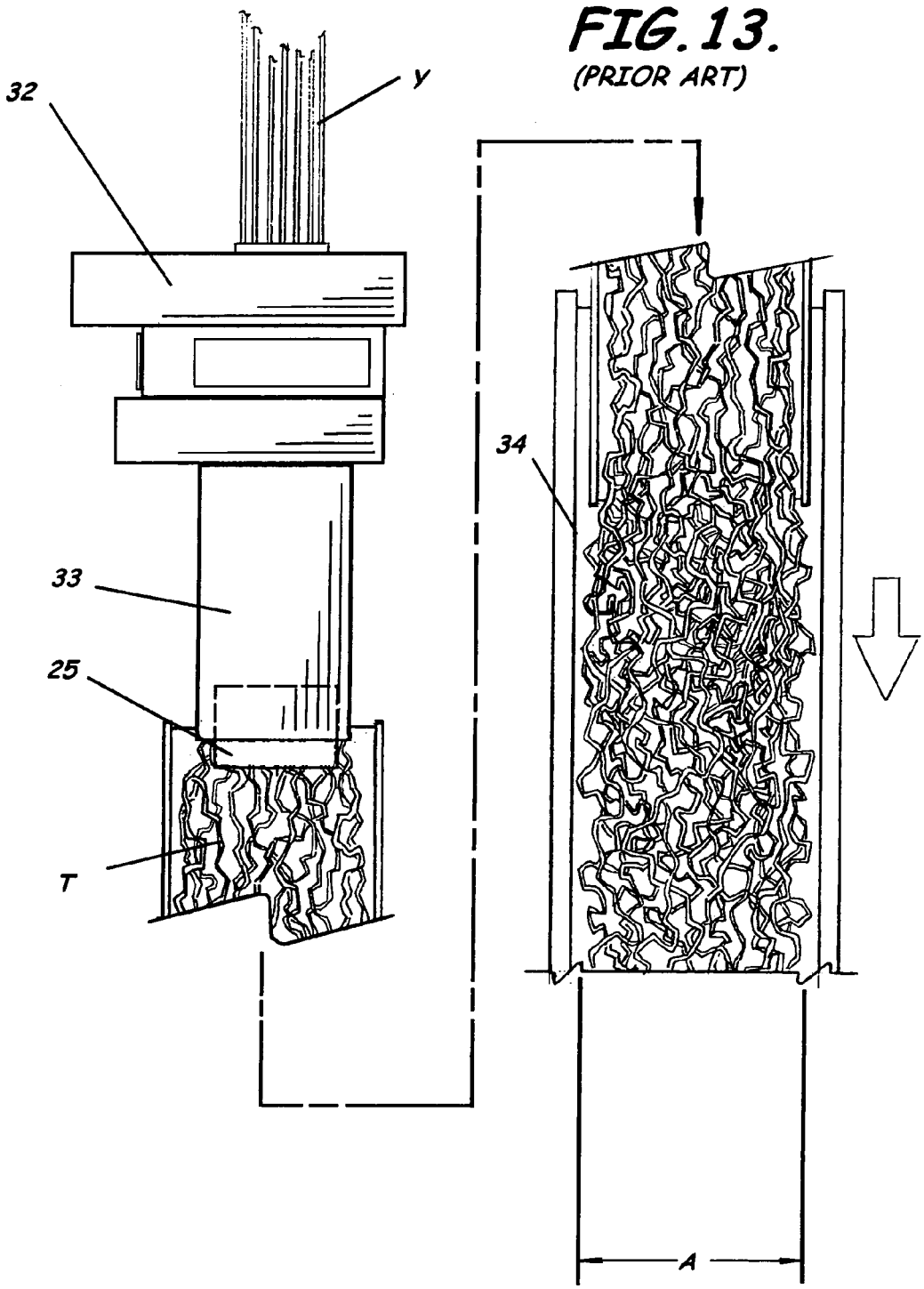
FIG. 13. (PRIOR ART)
FIG. 13 is a fragmentary top plan view of a system of texturizing yarn according to the prior art.

As shown in FIGS. 1-6, 12, and 14-16, the system 30 also includes a yarn conveyor belt 34, transfer belt, or other yarn transporter positioned downstream from the yarn stuffing container 33 to receive the textured yarn thereon and a yarn bundler 40 (see also FIGS. 3-20 for various embodiments thereof) positioned between the yarn stuffing container 33 and the yarn conveyor belt 34 to bundle the textured yarn T prior to being received on the yarn conveyor belt 34 so that the textured yarn T after passing through the yarn bundler 40 defines bundled textured yarn B which is then deposited onto the yarn conveyor belt 34 as illustrated. The system additionally can advantageously include a yarn compressor 35, e.g., a wheel having aluminum coating or other yarn handling surface, i.e., stainless steel, Teflon, on the outer peripheries thereof and a drive such as a motor driven at substantially the same speed as the conveyor belt 34 (see FIG. 2), an apron also having a yarn handling surface, or other compressing devices, to compress the bundled textured yarn B as it travels downstream on the yarn conveyor belt 34. Because the yarn bundler 40 can allow the drives, e.g., motor(s), of the yarn draw 29, the yarn conveyor belt 34, and a yarn take up 39 to run at higher speeds and thereby increase the throughput of the system 30, and the amount of yarn mass on the yarn conveyor belt 34 having similar widths as the prior art system such as shown in FIG. 13 can be substantially increased. As this yarn mass increases (see increase illustrated in FIGS. 14-15), the upward extent, height, or general mass of yarn can be greater such that compressing the yarn mass enhances control and positioning of the bundled textured yarn B on the yarn conveyor belt 34. The system 30 can also include a yarn bulker 36, as well understood by those skilled in the art, positioned downstream from the yarn bundler 40 and adjacent the yarn conveyor belt 34 to impart bulking of the bundled textured yarn B, e.g., initial heating, such as when the yarn conveyor belt 34 passes through the bulker 36 after the bundled textured yarn B has been compressed. The yarn bulker 36 can be of various configurations, types, and arrangements, but preferably allows the conveyor 34 to continue to move at high speed through the textured yarn production process.

As perhaps best shown in FIG. 2, the system 30 can also include a heat setting oven 38 positioned downstream from the yarn bundler 40, as well as the bulker 36, so that the yarn belt conveyor 34 having the bundled textured yarn B thereon passes through the heat setting oven 38 to heat set the bundled textured yarn B when passing therethrough. The system 30 can further include a yarn press belt 37 or band, e.g., formed of a mesh material, positioned to overlie the bundled textured yarn B prior to entry into the heat setting oven 38 to enhance press control or retaining of the bundled textured yarn in maintaining its position on the conveyor belt 34, especially during high speed continuous production, and yet also allowing the bundled textured yarn B to be readily heated as it passes through the heat setting oven 38. Also, a yarn cooler 28, e.g., one or more fans and/or an air cooling distance on the conveyor belt 34, can be positioned downstream from the heat setting oven 38 to cool the bundled textured yarn B after passing through the heat setting oven 38, and a yarn take-up 39, e.g., driven by motors and controlled by the controller 60, if desired, can be positioned downstream from the heat setting oven 38 to take-up the cooled bundled textured yarn B after being heat set as understood by those skilled in the art.

As illustrated in FIGS. 1-2, in a high speed continuous textured yarn production process, for example, the yarn draw 29 continuously draws the yarn Y from the yarn supply 31 at a selected speed responsive to the controller 60 as understood by those skilled in the art, and the yarn stuffing container 33 continuously periodically releases the textured yarn therefrom and into the yarn bundler 40. The yarn bundler 40, for example, provides a yarn bundling means for bundling textured yarn. The yarn bundler 40, for example, can include a collar 49 or other mount for positioning a tube 41, chute, channel, or other yarn bundling device and preferably is mounted to be rotated about an imaginary axis A (see FIG. 7) that extends through the tube 41, chute, channel, or other device. A motor 43 is positioned to rotatingly drive the tube 41 about the axis, e.g., a 360 degree rotation. Also, the yarn conveyor belt 34 continuously receives the bundled textured yarn B thereon and continuously passes the bundled textured yarn B through the heat setting oven 38. The yarn take-up 39 likewise continuously takes up the bundled textured yarn B after the press belt 37 is removed and after heat set of the yarn occurs. As understood by those skilled in the art, single lines, such as shown in FIG. 2, or multiple lines of stuffing containers 33 and bundlers 40 running in parallel as contemplated herein and by FIG. 1, can be used according to embodiments of a system 30 of the present invention. Also, as understood by those skilled in the art, the yarn or tow can be of various sizes, e.g., 40 to 150 denier and others as well, various plies, e.g., two ply, four ply, and other plies, various types, e.g., nylon, polyester, and other synthetics and wools, cottons, and other natural fiber yarns, counts, and twist levels as well.

As perhaps best illustrated in FIGS. 3-21, embodiments of an apparatus to bundle textured yarn T can have various embodiments. The apparatus can be provided by yarn bundling means for bundling textured yarn. The yarn bundling means, for example, can be provided by the yarn bundler 40 to bundle the textured yarn T. As perhaps best shown by the directional arrows in FIG. 12 extending along the conveyor belt 34, the bundling, for example, can be a light or loose twist, or other turning, wrapping, intertwining, imparted along a lengthwise extent of a bundle of textured yarn B as illustrated to enhance grouping, collecting, agitation, or positioning of the textured yarn T. The bundling, for example, also can reduce or eliminate outward travel (see prior art FIG. 13 (line A) as compared to FIGS. 14-15 (lines B and C) having bundling tube 41 and bundling tube 41' of two different circumferences) of yarn on the conveyor belt 34 toward outer peripheries of the belt 34 prior to entry into a heat setting oven. The outward travel of the texture yarn T, for example, can cause damage to the yarn, can cause problems with the production line such as broken yarn, belt or other machine clogging, damage, or down time. Because the bundling, for example, allows the textured yarn to be more compactly positioned and handled on the conveyor, speed can be increased, production loss decreased, and flexibility in operations enhanced. Additionally, the bundling advantageously can also reduce defects from the stuffing container 33 by using rotation to gently pull or tug, e.g., by the rotating force(s), the textured yarn T from the stuffing container 33. Further, too much twisting or tightening of the textured yarn T within a yarn bundler, for example, can increase snags or defects in the yarn. As such, a lighter/looser turn, twist, wrap, or intertwine is more advantageous. Although rotation or other turning of a tube, chute, channel or other bundling device has these distinct advantageous and differences as described herein, it will also be understood by those skilled in the art that other arrangements, shapes, or configurations of a tube, chute, channel or other bundling device that can impart bundling to the textured yarn can be used as well such as a bent or twisted tube where the textured yarn if forced through the tube or pulled through the tube to impart the bundling to or as means for bundling the textured yarn can be used as well according to embodiments of the present invention.

Figure 5:
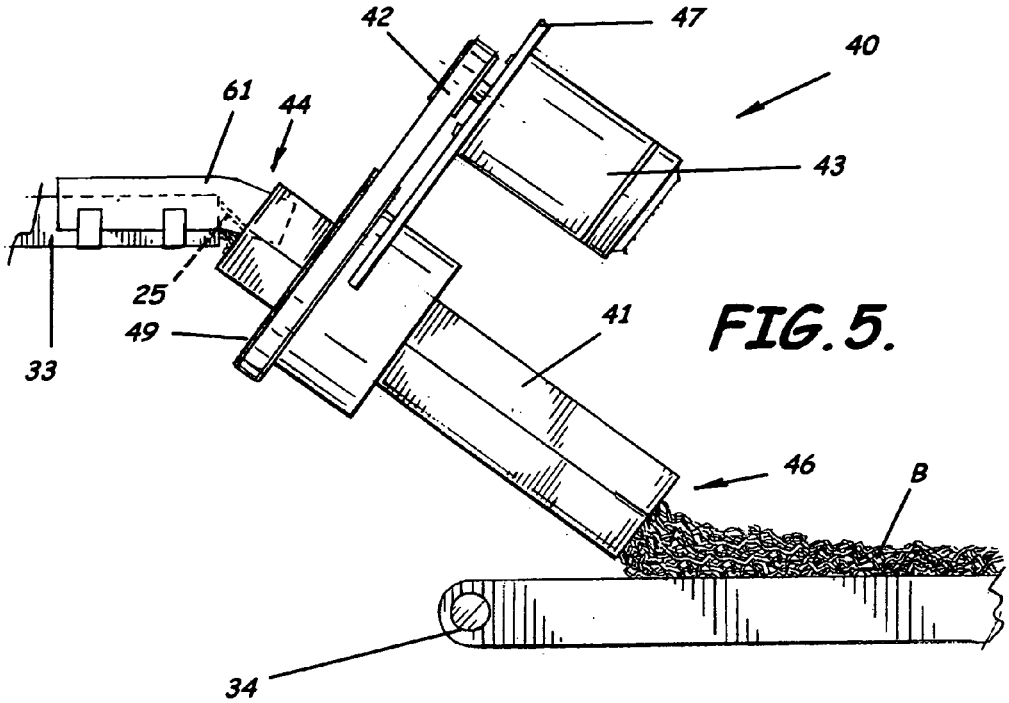
FIG. 5 is a side elevational view of an embodiment of a yarn bundler of a system to reduce production loss in textured yarn according to another embodiment of the present invention.

As shown in FIGS. 5-11 and 16-21, an embodiment of the yarn bundler 40, for example, can include a yarn bundling tube 41, chute, or channel that is stainless steel or Teflon or aluminum coated, as understood by those skilled in the art, on the inner surface or has another inner surface that will reduce the risk of imparting damage to the yarn. Also, a transition guide 61, e.g., Teflon or aluminum coated metal, plastic, or paper material, can also be used between the yarn stuffing container 33, e.g., mounted to the yarn stuffer box with tape, adhesive, or other connectors, and the yarn bundler 40 such as shown in FIG. 5 to accommodate for any air gap or difference between the stuffer box and the rotating tube. The yarn bundler 40 also can have a collar 49 preferably having a groove or slot for a drive belt 42, a drive mount 47, and a yarn bundling tube drive 43, e.g., a motor, positioned to rotate the yarn bundling tube 41 as the textured yarn received from the stuffing container 33 passes therethrough (see FIG. 16). The yarn bundling tube drive 43, in turn, is in electrical or other type of communication or otherwise connected to the controller 60. The bundling tube drive 43, for example, can impart a one-directional rotation about the axis A to increase the agitation and flow of the textured yarn T through the tube and yet impart a desired twist, turn, intertwine, or wrap of the textured yarn T into a desired bundle. Also, a tube 641 having somewhat of a conical shape as illustrated in FIG. 16 advantageously can allow ease of entrance of textured yarn T on one end and controlled rotation or bundling of the textured yarn as an output at the other end. For example, the yarn bundling tube 41, 141, 241, 341, 441, 541, 641 can have a yarn receiving end 44, 144, 244, 344, 444, 544, 644 positioned adjacent the yarn stuffing container to receive the textured yarn T from the yarn stuffing container 33 therein and a yarn depositing end 46, 146, 246, 346, 446, 546, 646 positioned at a lower elevation than the yarn receiving end 44, 144, 244, 344, 444, 544, 644 and positioned adjacent the yarn conveyor belt 34 so that the bundled textured yarn B passing out of the yarn bundling tube 41 is deposited onto the yarn conveyor belt 34. The yarn bundling tube 541 also, for example, can include inner surface portions 545 or circumferences having different shapes or inwardly extending into a tube, chute, or channel to different extents or levels as well (see FIG. 11). The yarn bundling tube 41 advantageously can rotate about an imaginary tube axis A extending through substantially an entire lengthwise extent of the yarn bundling tube 41 (see FIG. 7) and can have various shapes, structures, and inner and outer circumferences such as illustrated in FIGS. 7-11 and 17-21.

In various embodiments of the yarn bundling tube 41, the yarn-receiving end of the yarn bundling tube can have a larger inner circumference than the yarn-depositing end of the yarn bundling tube 41. The outer circumference of the yarn receiving end of the yarn bundling tube 41, for example, can have one of the following shapes: circular, non-circular, rectangular, triangular, and hexagonal, as illustrated, or other selected shapes as understood by those skilled in the art. The yarn bundling tube 41 has at least one inner surface portion positioned therein so that the textured yarn received into the yarn bundling tube impinges on the at least one surface portion during rotation of the yarn bundling tube 41 so that the at least one inner surface portion defines at least one impinging surface to thereby enable the textured yarn T to be rotatingly bundled as the textured yarn T passes through the yarn bundling tube 41 when rotating the yarn bundling tube 41 with the yarn bundling tube drive 43. The at least one impinging surface, for example, can include at least one of the following: a corner of an inner surface of the yarn bundling tube 41, a bend in an inner surface of the yarn bundling tube 41, a non-arcuate portion of an inner surface of the yarn bundling tube 41, a protrusion extending inwardly from an inner surface of the yarn bundling tube 41, a plurality of angled surfaces formed in an inner surface of the yarn bundling tube 41, and an arc region of an inner surface of the yarn bundling tube 41 having a substantially different arc than other regions of the inner surface.

As illustrated, the yarn conveyor belt 34 has a selected width of an upper surface portion thereof extending along a selected length of the upper surface portion. The textured yarn T has a yarn mass, and the yarn bundler 40 substantially increases the yarn mass of the textured yarn per the selected length of the yarn conveyor belt 34 when deposited thereon (see FIGS. 14-15) and when the selected speed of the yarn draw is substantially increased over a system (see prior art FIG. 13) not having the yarn bundler positioned between the yarn stuffing container and the yarn belt.

As illustrated in FIGS. 1-21, embodiments of the present invention also include methods of producing textured yarn. A method of producing textured yarn includes crimping yarn Y, e.g., in a yarn stuffing container 33 or other crimping device as understood by those skilled in the art, to define textured yarn T, bundling the textured yarn T, e.g., imparting a light or loose twist in a collection, group, or mass of textured yarn T, to define bundled textured yarn B, depositing the bundled textured yarn B onto a conveyor 34, and taking up the bundled textured yarn B after heating the bundled textured yarn B. The method can also include compressing the bundled textured yarn B prior to heating the bundled textured yarn B.

Another embodiment of a method of producing textured yarn includes rotating a yarn bundler 40 about an imaginary axis A extending through the yarn bundler 40, receiving textured yarn T into the rotating yarn bundler 40, and bundling the textured yarn prior to exiting the yarn bundler 40. The method also can include depositing the bundled textured yarn onto a moving conveyor 34, compressing the bundled textured yarn B, and heating the bundled textured yarn B after compressing.

Figure 14:
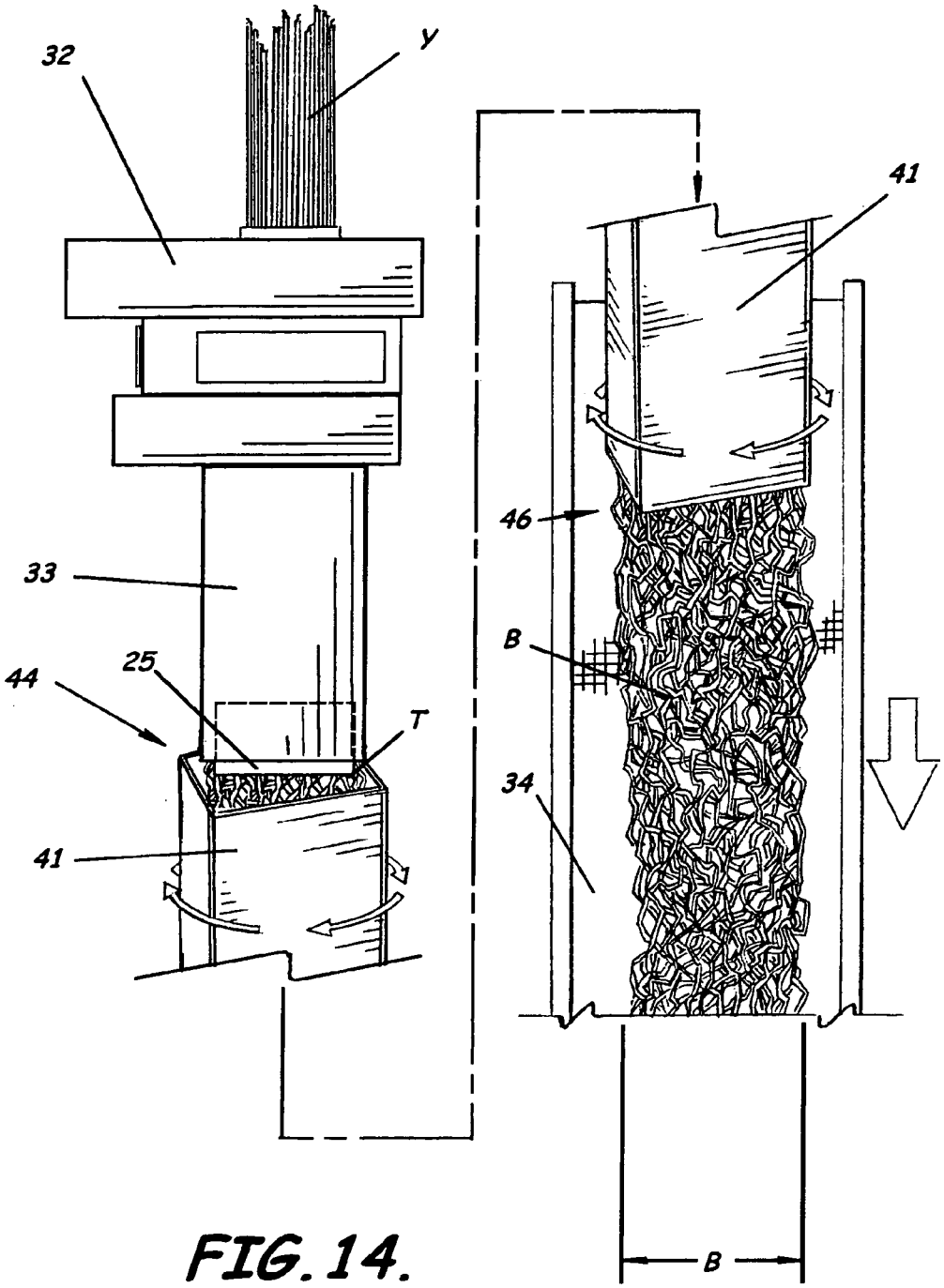
FIG. 14 is a fragmentary top plan view of a system to reduce production loss in textured yarn according to still another embodiment of the present invention.
Figure 15:
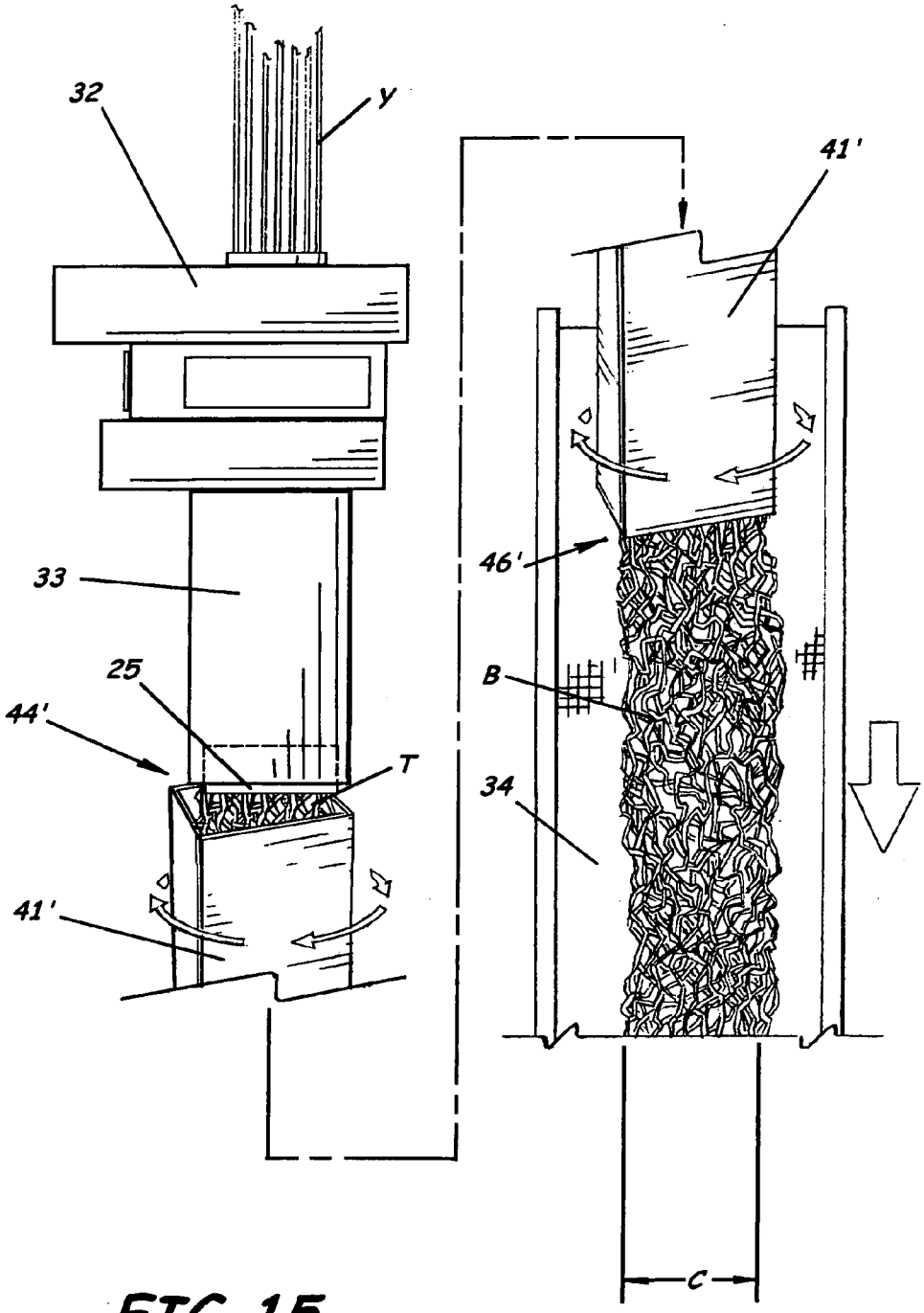
FIG. 15 is a fragmentary top plan view of a system to reduce production loss in textured yarn according to a further embodiment of the present invention.

Still another method of producing textured yarn such as to increase production speed of textured yarn. The method, for example, can include increasing the amount of textured yarn mass deposited onto a preselected area of a moving conveyor belt 34 having a preselected width when increasing the speed of yarn being supplied to a yarn texturizer over the amount of textured yarn deposited in the preselected area at a slower speed (see prior art FIG. 13 and FIGS. 14-15 illustrating embodiments of the present invention). The method also can include compressing the increased amount of textured yarn mass as the increased amount of textured yarn mass travels on the moving conveyor belt.

The present invention additionally provides a method for increasing production speed in a textured yarn production process. The method includes bundling textured yarn B, depositing the bundled texturized yarn B onto a moving conveyor 34, and compressing the bundled textured yarn when moving on the conveyor.

The present invention also provides a method of doing business including charging a fee for the amount of money saved by a textured yarn manufacturer for reducing production loss in a continuous textured yarn production process. The fee, for example, can be a percentage of the money saved by the textured yarn manufacturer. The method can include installing at least one yarn bundler 40 into the continuous textured yarn production process at a facility of the textured yarn manufacturer to thereby allow an increase in production speed of textured yarn on an existing textured yarn production line.

By providing a system 30, apparatus, and methods of reducing production loss in textured yarn, yarn manufacturers can significantly reduce production speeds of textured yarn production systems and processes. In turn, this saves time, money, and labor and substantially increases flexibility for a manufacturer such as associated with scheduling needs, meeting customer demands, and the ability to attempt to produce various types of customized textured yarn or textile products. Such a system, apparatus, and methods of embodiments of the present invention, for example, also advantageously allow a textured yarn manufacturer to increase production speed and/or decrease production in loss and yet only pay for such enhancements if money is saved by the manufacturer.

In the drawings and specification, there have been disclosed various illustrated embodiments of the invention and, although specific terms are employed, they are used in a generic and descriptive sense only and not for the purpose of limitation, the scope of the invention being set forth in the following claims.

The invention claimed is:

1. A yarn texturizing system comprising:

a yarn supply having yarn positioned thereon;

a yarn stuffing container positioned downstream from the yarn supply to receive the yarn from the yarn supply so that the received yarn is stuffed within the yarn stuffing container and periodically released therefrom in a crimped position to thereby define textured yarn;

a yarn draw positioned downstream from the yarn supply to draw the yarn to the yarn-stuffing container at a selected speed;

a yarn conveyor belt positioned downstream from the yam-stuffing container to receive the textured yarn thereon;

a yarn bundler positioned between the yarn stuffing container and the yarn conveyor belt to bundle the textured yarn prior to being received on the yarn belt so that the textured yarn passing through the yarn bundler defines bundled textured yarn;

a heat setting oven positioned downstream from the yarn bundler so that the yarn belt having the bundled textured yarn thereon passes through the heat setting oven to heat set the bundled textured yarn when passing therethrough; and a yarn take-up positioned downstream from the heat setting oven to take-up the bundled textured yarn after being heat set.

2. A system as defined in claim 1, wherein the yarn bundler includes a yarn bundling tube and a yarn bundling tube drive positioned to rotate the yarn bundling tube as the textured yarn received from the stuffing container passes therethrough.

3. A system as defined in claim 2, wherein the yarn bundling tube has a yarn receiving end positioned adjacent the yarn stuffing container to receive the textured yarn from the yarn stuffing container therein and a yarn depositing end positioned at a lower elevation than the yarn receiving end and positioned adjacent the yarn conveyor belt so that the bundled textured yarn passing out of the yarn bundling tube is deposited onto the yarn conveyor belt, and wherein the yarn tube rotates about an imaginary tube axis extending through substantially an entire lengthwise extent of the yarn bundling tube.

4. A system as defined in claim 3, wherein the yarn-receiving end of the yarn bundling tube has a larger inner circumference than the yarn-depositing end of the yarn bundling tube.

5. A system as defined in claim 3, wherein the outer circumference of the yarn receiving end of the yarn bundling tube has one of the following shapes: circular, non-circular, rectangular, triangular, and hexagonal.

6. A system as defined in claim 5, wherein the yarn bundling tube has at least one inner surface portion positioned therein so that the textured yarn received into the yarn bundling tube impinges on the at least one surface portion during rotation of the yarn bundling tube so that the at least one inner surface portion defines at least one impinging surface to thereby enable the textured yarn to be rotatingly bundled as the textured yarn passes through the yarn bundling tube when rotating the yarn bundling tube with the yarn bundling tube drive.

7. A system as defined in claim 6, wherein the at least one impinging surface comprises at least one of the following: a corner of an inner surface of the yarn bundling tube, a bend in an inner surface of the yarn bundling tube, a non-arcuate portion of an inner surface of the yarn bundling tube, a protrusion extending inwardly from an inner surface of the yarn bundling tube, a plurality of angled surfaces formed in an inner surface of the yarn bundling tube, and an arc region of an inner surface of the yarn bundling tube having a substantially different arc than other regions of the inner surface.

8. A system as defined in claim 1, wherein the yarn draw continuously draws the yarn from the yarn supply at a selected speed, wherein the yarn stuffing container continuously periodically releases the textured yarn therefrom and into the yarn bundler, wherein the yarn belt continuously receives the bundled textured yarn thereon and continuously passes the bundled textured yarn through the heat setting oven, wherein the yarn take-up continuously takes up the bundled textured yarn after heat set, and wherein the system further includes a bundled yarn compressor positioned downstream from the yarn bundler to compress accumulated mass of the bundled textured yarn on the yarn conveyor belt.

9. A system as defined in claim 8, wherein the yarn belt has a selected width of an upper surface portion thereof extending along a selected length of the upper surface portion, wherein the textured yarn has a yarn mass, and wherein the yarn bundler substantially increases the yarn mass of the textured yarn per the selected length of the yarn belt when deposited thereon and when the selected speed of the yarn draw is substantially increased over a system not having the yarn bundler positioned between the yarn stuffing container and the yarn belt.

10. A yarn texturizing system comprising:

a yarn supply having yarn positioned thereon;

a yarn stuffing container positioned downstream from the yarn supply to receive the yarn from the yam supply so that the received yarn is stuffed within the yarn stuffing container and periodically released therefrom in a crimped position to thereby define textured yarn;

a yarn draw positioned downstream from the yarn supply to draw the yarn to the yarn-stuffing container at a selected speed;

a yarn conveyor belt positioned downstream from the yarn stuffing container to receive the textured yarn thereon; and a yarn bundler positioned between the yarn stuffing container and the yarn conveyor belt to bundle the textured yarn prior to being received on the yarn belt so that the textured yarn passing through the yarn bundler defines bundled textured yarn.

11. A system as defined in claim 10, further comprising a bulker positioned downstream from the yarn bundler and adjacent the yarn conveyor belt to bulk the bundled textured yarn, a heat setting oven positioned downstream from the yarn bundler so that the yarn belt having the bundled textured yarn thereon passes through the heat setting oven to heat set the bundled textured yarn when passing therethrough, a yarn cooler positioned downstream from the heat setting oven to cool the bundled textured yarn, and a yarn take-up positioned downstream from the yarn cooler and the heat setting oven to take-up the bundled textured yarn after being cooled.

12. A system as defined in claim 10, wherein the yarn bundler includes a yarn bundling tube and a yarn bundling tube drive positioned to rotate the yarn bundling tube as the textured yarn received from the stuffing container passes therethrough.

13. A system as defined in claim 12, wherein the yarn bundling tube has a yarn receiving end positioned adjacent the yarn stuffing container to receive the textured yarn from the yarn stuffing container therein and a yarn depositing end positioned at a lower elevation than the yarn receiving end and positioned adjacent the yarn conveyor belt so that the bundled textured yarn passing out of the yarn bundling tube is deposited onto the yarn conveyor belt, and wherein the yarn tube rotates about an imaginary tube axis extending through substantially an entire lengthwise extent of the yarn bundling tube.

14. A system as defined in claim 13, wherein the yarn-receiving end of the yarn bundling tube has a larger inner circumference than the yarn-depositing end of the yarn bundling tube.

15. A system as defined in claim 13, wherein the outer circumference of the yarn receiving end of the yarn bundling tube has one of the following shapes: circular, non-circular, rectangular, triangular, and hexagonal.

16. A system as defined in claim 10, wherein the yarn bundler has at least one inner surface portion positioned therein so that the textured yarn received into the yarn bundler impinges on the at least one inner surface portion during rotation of the yarn bundler so that the at least one inner surface portion defines at least one impinging surface to thereby enable the textured yarn to be rotatingly bundled as the textured yarn passes through the yarn bundler when rotating the yarn bundler.

17. A system as defined in claim 16, wherein the at least one impinging surface comprises at least one of the following: a corner of an inner surface of the yarn bundler, a bend in an inner surface of the yarn bundler, a non-arcuate portion of an inner surface of the yarn bundler, a protrusion extending inwardly from an inner surface of the yarn bundler, a plurality of angled surfaces formed in an inner surface of the yarn bundler, and an arc region of an inner surface of the yarn bundler having a substantially different arc than other regions of the inner surface.

18. A system as defined in claim 10, wherein the yarn draw continuously draws the yarn from the yarn supply at a selected speed, wherein the yarn stuffing container continuously periodically releases the textured yarn therefrom and into the yarn bundler, wherein the yarn conveyor belt continuously receives the bundled textured yarn thereon and continuously passes the bundled textured yarn downstream, and wherein the system further includes a bundled yarn compressor positioned downstream from the yarn bundler to compress accumulated mass of the bundled textured yarn on the yarn conveyor belt.

19. A system as defined in claim 10, wherein the yarn conveyor belt has a selected width of an upper surface portion thereof extending along a selected length of the upper surface portion, wherein the textured yarn has a yarn mass, and wherein the yarn bundler substantially increases the yarn mass of the textured yarn per the selected length of the yarn belt when deposited thereon and when the selected speed of the yarn draw is substantially increased over a system not having the yarn bundler positioned between the yarn stuffing container and the yarn conveyor belt.

* * * * *